United States Patent [19]

Mainland

[11] Patent Number: 4,713,903

[45] Date of Patent: Dec. 22, 1987

[54] CHOKE ASSEMBLIES FOR SHOTGUNS

[75] Inventor: Donald R. Mainland, Racine, Wis.

[73] Assignee: Kolar Arms, Racine, Wis.

[21] Appl. No.: 869,351

[22] Filed: Jun. 2, 1986

[51] Int. Cl.[4] ..... F41C 21/10; F41C 27/00

[52] U.S. Cl. ..... 42/79; 42/76.02

[58] Field of Search ..... 42/77, 79, 76.02; 285/397, 370, 383

[56] References Cited

U.S. PATENT DOCUMENTS

| | | | |
|---|---|---|---|
| 555,582 | 3/1896 | Perl | 42/77 |
| 611,062 | 9/1898 | Darms | 42/77 |
| 1,468,891 | 9/1923 | Tucker | 42/77 |
| 1,538,561 | 5/1925 | Koller | 42/77 X |
| 2,239,942 | 4/1941 | Stone et al. | 285/383 X |
| 2,337,021 | 12/1943 | Barbieri | 42/77 |
| 2,423,471 | 7/1947 | Summerbell | 42/77 X |
| 3,138,889 | 6/1964 | Groover | 42/77 |
| 3,339,304 | 9/1967 | Knode et al. | 42/77 |
| 3,805,434 | 4/1974 | Sudano | 42/77 |

*Primary Examiner*—David H. Brown

*Attorney, Agent, or Firm*—James E. Nilles; Thomas F. Kirby

[57] ABSTRACT

Two types of choke assemblies are provided to enable a shotgun of specific gauge to be modified in the field to receive a shotgun shell of smaller gauge and also to provide a choke of desired characteristics to suit the needs of the shooter, as for skeet or trap shooting or hunting. Each choke assembly comprises an aluminum tube insertable into the breech end of the shotgun barrel and has integral external bosses to ensure a snug fit. The breech end of the tube is chambered to receive a shotgun shell and the muzzle end of the tube is internally threaded. In one type of choke assembly, a choke is screwed and glued in the threaded tube end at the factory and the entire assembly is installed in the shotgun in the field. Thus, with a plurality of tubes of the same gauge, each would have a different choke permanently attached. In the other type of choke assembly, a hollow threaded adapter is screwed and glued in the threaded tube end at the factory and chokes of various types are threadedly and removably attachable to the adapter on the tube in the field. Thus, with a plurality of tubes of different gauges, each tube could have a plurality of different chokes releasably mounted thereon. The choke and adapter also have external bosses to ensure a snug fit in the shotgun barrel.

2 Claims, 8 Drawing Figures

CHOKE ASSEMBLIES FOR SHOTGUNS

BACKGROUND OF THE INVENTION

1. Field of Use

This invention relates generally to choke assemblies for shotguns and, in particular, to improved choke assemblies which enable a shooter to modify a shotgun of a specific gauge to receive a shotgun shell of smaller size and also provide a choke of desired characteristic.

2. Description of the Prior Art

Shooters employ shotguns of various gauges (typically 12, 20, 28 or 410) for various types of shooting (such as skeet, trap, and hunting) and sometimes desire to employ chokes of various kinds to alter the shot pattern. Some prior art shotguns have a choke integrally formed on the inside of the muzzle end of the barrel. Some chokes are adapted to be detachably mounted on the muzzle, as by threaded attachment means formed on the inside or outside of the muzzle end of the bore, or by other suitable means. An adjustable (Cutts type) choke is known for detachable mounting on the muzzle. Some chokes take the form of a one-piece smaller-gauge tube or sleeve which fits into the barrel of a larger-gauge shotgun and the choke is integral with the muzzle end of the tube. Groover, U.S. Pat. No. 3,138,889, shows smaller-gauge tube T for insertion into a shotgun barrel B and having a choke-like sleeve S which threads onto the muzzle end of the tube. Knode, U.S. Pat. No. 3,339,304, shows a two-piece adapter tube for reducing gun barrel diameter and including a threaded and glued joint near the breech end of the tube. The following U.S. patents show other types of attachment devices for altering the barrels of guns: Dial 2,641,860; Thomas 3,384,989; Thomason 3,196,569; Tucker 1,468,891; Sudano 3,805,434; Reudelsterz 4,404,765; and Ferretti 4,459,774.

Some of the drawbacks of prior art chokes and insertable sleeves which reduce bore diameter or gauge can be summarized as follows. Prior art sleeves used for bore reduction are made in various grades for each bore size. Titanium or stainless steel, which are expensive materials, are typically used in the higher grade sleeves, whereas cheaper but heavier materials are used in lower grade sleeves. The weight increase may penalize the shooter's performance. Furthermore, if a choke is integrally formed with a sleeve, it becomes difficult and costly to manufacture because of the problems of machining within the bore. Complex choke configurations (such as parabolic chokes) are very costly and difficult to machine in long sleeves. To overcome some of these problems, choke sections have been swaged onto a tube and then honed to final choke size and configuration, but this is also relatively expensive. In the field, use of sleeves having integrally-formed or swaged-on chokes required the shooter to have available (depending on his needs) a costly array of inserts—one for each specific gauge and choke type.

SUMMARY OF THE INVENTION

Two types of choke assemblies are provided to enable a shotgun of specific gauge to be modified in the field to receive a shotgun shell of smaller gauge and also to provide a choke of desired characteristics to suit the needs of the shooter, as for skeet or trap shooting or hunting. Each choke assembly comprises an aluminum tube insertable into the breech end of the shotgun barrel and has integral external bosses to ensure a snug fit. The breech end of the tube is chambered to receive a shotgun shell and the muzzle end of the tube is internally threaded. In one type of choke assembly, a choke is screwed and glued in the threaded tube end at the factory and the entire assembly is installed in the shotgun in the field. Thus, with a plurality of tubes of the same gauge, each would have a different choke permanently attached. In the other type of choke assembly, a hollow threaded adapter is screwed and glued in the threaded tube end at the factory and chokes of various types are threadedly and removably attachable to the adapter on the tube in the field. Thus, with a plurality of tubes of different gauges, each tube could have a plurality of different chokes releasably mounted thereon. The choke and adapter also have external bosses to ensure a snug fit in the shotgun barrel.

More specifically, each choke assembly is adapted for installation in the bore of the barrel of a shotgun of predetermined gauge to reduce the gauge of the shotgun bore and to provide a shot pattern of a predetermined characteristic. Each choke assembly comprises a tube having a breech end and a muzzle end and a tube bore having a gauge less than the predetermined gauge of the shotgun. The tube comprises integrally formed axially spaced apart supporting bosses on the exterior thereof of substantially the same diameter as the shotgun barrel bore. The choke, which is substantially shorter than the tube, has a breech end and a muzzle end and comprises a choke bore. The choke also comprises integrally formed axially spaced apart supporting bosses on the exterior thereof of substantially the same diameter as the shotgun barrel. Connecting means are provided for connecting the breech end of the choke and the muzzle end of the tube and broadly comprises threads on the choke and on the tube and solidified adhesive on at least the threads on the tube.

In the aforesaid one type of choke assembly the threads on the choke and on the tube are inter-engaged with each other and the solidified adhesive is disposed therebetween to serve as the connecting means.

In the aforesaid other type of choke assembly the connecting means comprises an adapter member having an adapter bore and having a breech end and a muzzle end with threads at the breech end and the muzzle end thereof. The threads on the tube are inter-engaged with the threads on the breech end of the adapter member. The threads on the choke are inter-engaged with the threads on the muzzle end of the adapter member. The solidified adhesive is disposed only between the inter-engaged threads on the tube and on the breech end of the adapter member. The adapter member comprises an integrally formed supporting boss on the exterior thereof of substantially the same diameter as the shotgun barrel bore.

In both embodiments the tube is fabricated of metal selected from a class of metals consisting of aluminum, magnesium and alloys thereof, and the choke is fabricated of metal selected from a class of metals consisting of steel, stainless steel, titanium and alloys thereof. The adapter member is fabricated of a metal selected from a class of metals consisting of steel, stainless steel, titanium and alloys thereof.

Choke assemblies in accordance with the invention offer numerous advantages over the prior art. For example, the tubes are fabricated of low cost, light-weight easily machined aluminum or other comparable metals (such as magnesium) or alloys. The chokes (and adapter, if used) are a short, economically produced components which are less costly than long prior art tubes, and are easily machined precisely, even when complex internal choke bore shapes are required. Thus, overall economic advantages accure to the manufacture and purchaser alike. The use of both threads and adhesives at factory-made joints which are not to be disassembled in the field (but can be in the factory, if choke or adapter replacement is required) facilitates quick but accurate and precise alignment during factory assembly and ensures that such alignment is permanent. In the first embodiment or type wherein the choke is permanently mounted on the tube and the entire assembly is replaceable, it is still economical, in view of production costs, for the user to have an array of light-weight assemblies of the same gauge but with various types of chokes mountable thereon. In the second embodiment or type wherein the choke is field-replaceable, even more advantages and combination of gauge and choke-type are economically feasible. Other objects and advantages of the invention will hereinafter appear.

DRAWINGS

DESCRIPTION OF PREFERRED EMBODIMENTS

Figure 1:
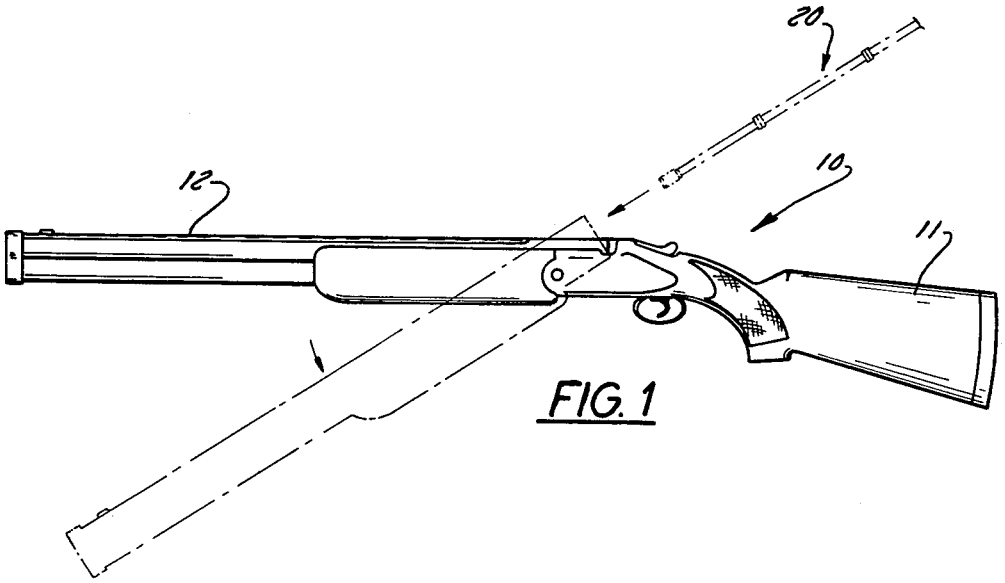
FIG. 1 is a side elevation view of a shotgun in which a choke assembly in accordance with the invention (shown in phantom) is advantageously used.

FIG. 1 shows a shotgun 10 which comprises a stock 11 and a tubular barrel 12 having a cylindrical bore 13 (FIGS. 6 and 7) which, for example, is of relatively large twelve-gauge size or diameter. As FIG. 1 shows in broken lines, barrel 12 can be manually swung down relative to stock 11 or "broken" to enable it to be loaded with a shotgun shell (not shown) and shotgun 10 is re-cocked when the barrel is swung back up to firing position. When barrel 12 is swung down, a choke assembly 20 in accordance with the invention, shown in broken lines in FIG. 1, can be axially inserted into or removed from barrel bore 13.

Two types or embodiments of choke assemblies 20 (FIGS. 1, 2, 3 and 6) and 30 (FIGS. 4, 5 and 7) are provided to enable shotgun barrel bore 13 of a specific gauge (twelve-gauge, for example) to be modified in the field to receive a shotgun shell (not shown) of smaller gauge and also to provide a choke of desired characteristics which forms a shot pattern to suit the needs of the shooter, as for skeet or trap shooting or hunting. Each choke assembly 20 and 30 comprises a one-piece light-weight metal tube 22 having a breech end 21 and a muzzle end 23 and a tube bore 24 having a gauge less than the predetermined gauge of shotgun barrel bore 13. The tube 22 comprises integrally formed axially spaced-apart supporting bosses 25, 26 and 27 on the exterior thereof of nearly the same diameter as shotgun barrel bore 13, but slightly smaller to enable a sliding fit.

The breech end of tube bore 24 is chambered as at 28 (FIGS. 2 and 4) to receive a shotgun shell (not shown) of appropriate gauge. The muzzle end of tube bore 24 is provided with internal threads 29 (FIGS. 3, 4, 6 and 7) which are formed within boss 27. In choke assembly 20, a choke 32 is screwed and glued in the threads 29 at the factory and the entire assembly 20 is installed in shotgun 10 in the field. Thus, with a plurality of tubes 22 of the same gauge, each would have a choke 32 of different internal shape permanently attached (compare choke 32 in FIG. 6 and choke 32A in FIG. 8 which has a parabolic bore 32B). In choke assembly 30, a hollow threaded adapter member 40 is screwed and glued in the threads 29 at the factory and a choke 50 of desired internal shape or type is threadedly and removably attachable to adapter 40 on tube 22 in the field. Thus, with a plurality of tubes 22 of different gauges and each having an adapter 40 thereon, each adapter could have a plurality of chokes 50 of desired internal shape releasably or detachably mounted thereon. The chokes 32 and 50 and adapter 40 have external bosses thereon (hereinafter described) to ensure a snug fit in shotgun barrel bore 13.

Figure 2:
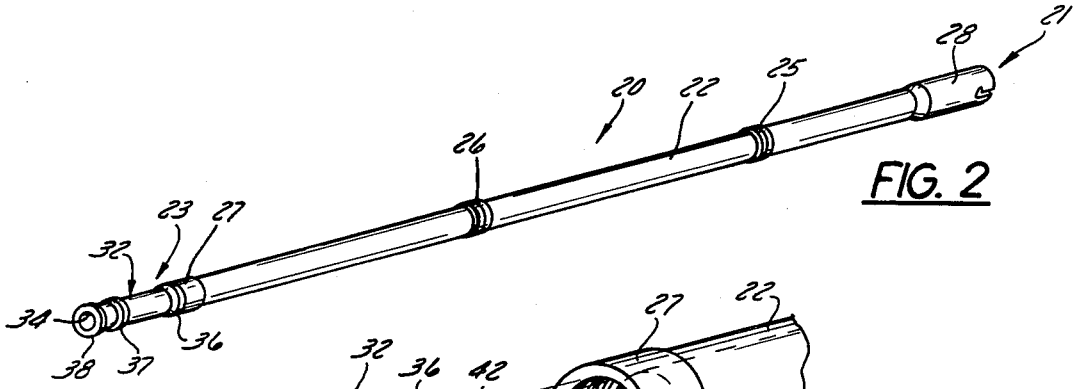
FIG. 2 is an isometric view of a first embodiment or type of choke assembly in accordance with the invention.
Figure 3:
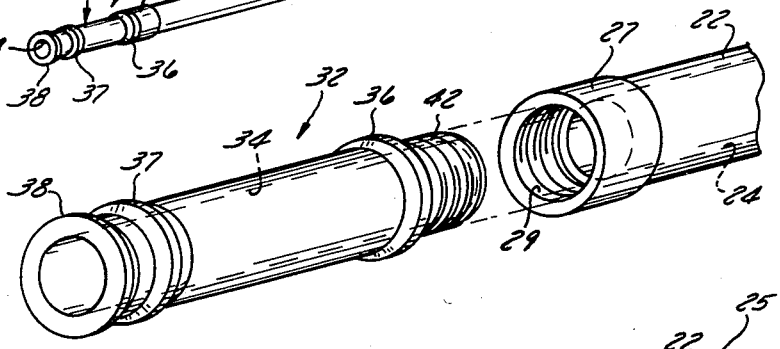
FIG. 3 is an enlarged exploded isometric view of the choke and muzzle end of the tube of FIG. 2.
Figure 6:
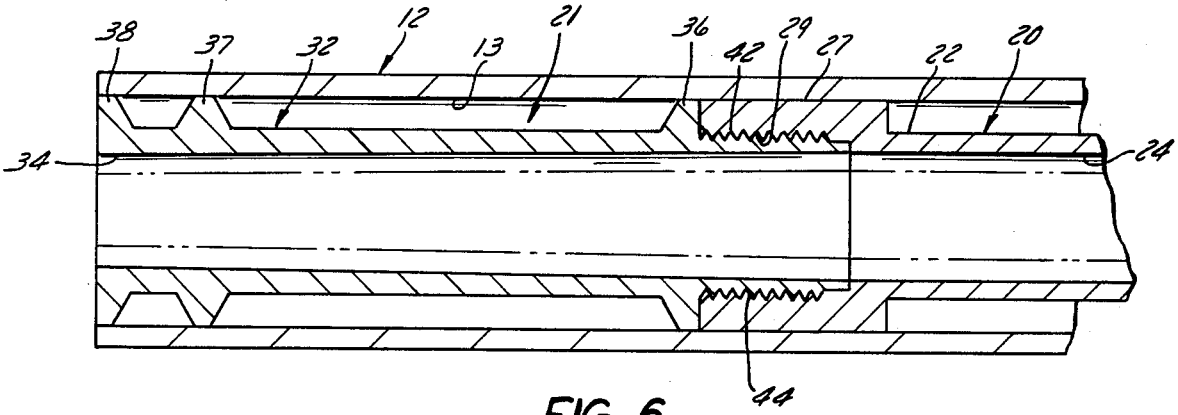
FIG. 6 is an enlarged longitudinal cross-section view of the muzzle end of the embodiment shown in FIG. 2 when disposed in a shotgun barrel.

Referring to FIGS. 2, 3 and 6 depicting choke assembly 20, choke 32, which is substantially shorter than tube 22, has a breech end and a muzzle end and comprises a choke bore 34. The choke 32 also comprises integrally formed axially spaced apart supporting bosses 36, 37 and 38 on the exterior thereof of nearly the same diameter as shotgun barrel bore 13, but slightly smaller to ensure a snug sliding fit. Connecting means are provided for connecting the breech end of choke 32 and the muzzle end of tube 22 and comprise three elements, namely: external threads 42 on choke 32 adjacent boss 36, internal threads 29 on tube 22 and solidified adhesive 44 (FIG. 6) which adheres to metal. The threads 42 and 29 are inter-engaged with each other and the solidified adhesive 44 is disposed therebetween. The adhesive may, for example, take the form of commercially available LOK-TITE TM.

Figure 4:
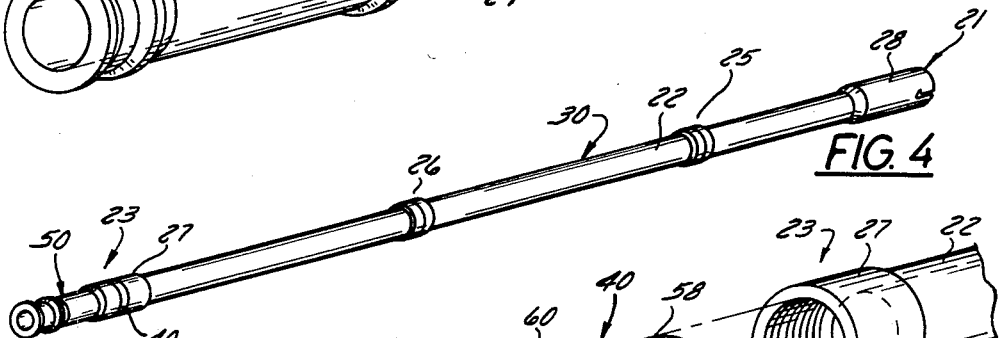
FIG. 4 is an isometric view of a second embodiment or type of choke assembly in accordance with the invention, and which includes an adapter member.
Figure 5:
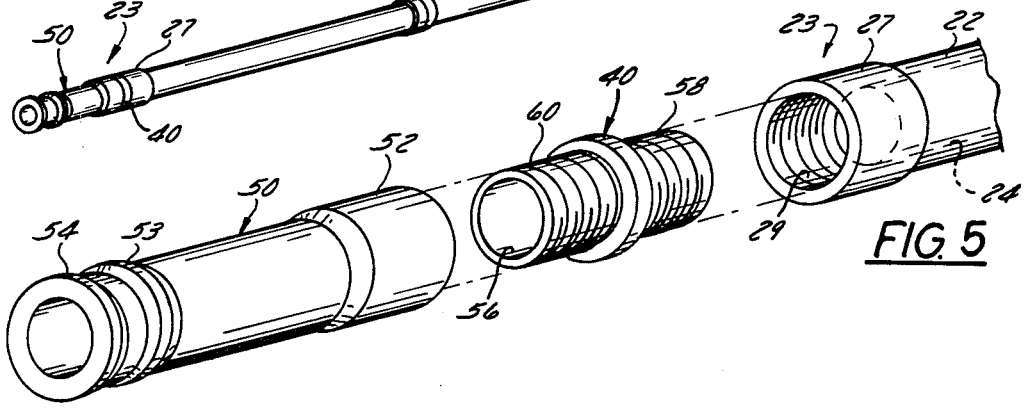
FIG. 5 is an enlarged exploded isometric view of the choke, adapter member and muzzle end of the tube of FIG. 4.
Figure 7:
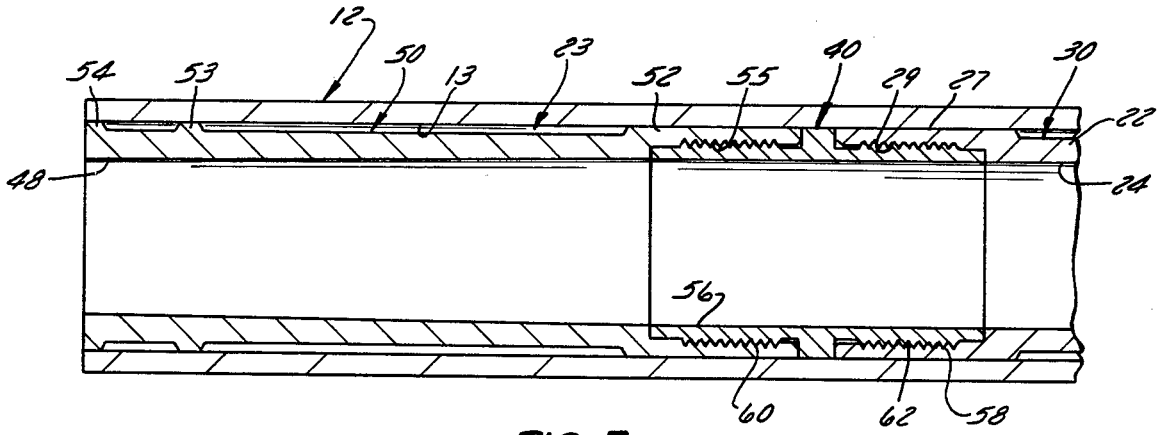
FIG. 7 is an enlarged longitudinal cross-section view of FIG. 4 when disposed in a shotgun barrel.

Referring to FIGS. 4, 5 and 7 depicting choke assembly 30, choke 50, which is substantially shorter than tube 22, has a breech end and a muzzle end and comprises a choke bore 48. The choke 50 also comprises integrally formed axially spaced apart supporting bosses 52, 53 and 54 on the exterior thereof of nearly the same diameter as shotgun barrel bore 13, but slightly smaller to ensure a snug sliding fit. The breech end of choke 50 is provided with internal threads 55 which are formed within boss 52. Connecting means are provided for connecting the breech end of choke 50 and the muzzle end of tube 22. Such connecting means comprise adapter member 40 having an adapter bore 56 and having a breech end and a muzzle end with external threads 58 and 60 at the breech end and the muzzle end thefeof, respectively. The internal threads 29 on tube 22 are inter-engaged with the external threads 58 on the breech end of adapter member 40. The internal threads 55 on choke 50 are inter-engaged with the threads 60 on the muzzle end of adapter member 40. The connecting means further comprise solidified adhesive 62, like that previously described, which is disposed only between the inter-engaged threads 29 on tube 22 and the threads 58 on the breech end of adapter member 40.

In both embodiments, tube 22 is fabricated of light-weight metal selected from a class of metals consisting of aluminum, magnesium and alloys thereof. The chokes 32 and 50 are fabricated of hard metal selected from a class of metals consisting of steel, stainless steel, titanium and alloys thereof. The adapter member 40 is fabricated of hard metal selected from a class of metals consisting of steel, stainless steel, titanium and alloys thereof.

Figure 8:
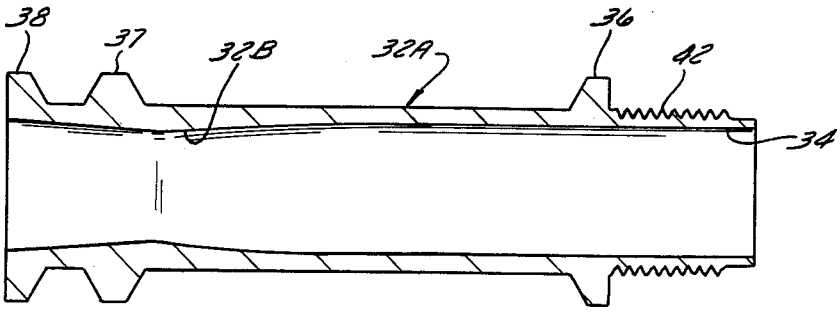
FIG. 8 is an enlarged cross-section view of another choke which can be used to replace the choke shown in FIGS. 2, 3 and 6.

FIG. 8 shows that choke 34A has parabolic bore 32B which is a relatively complex shape to machine. However, machining is facilitated by the fact that choke 34A is a relatively short component. Choke 34A is constructed to replace choke 34 of FIGS. 2, 3 and 6, for example, and has the same arrangement of threads 42 and bosses 36, 37 and 38. As will be understood, chokes (not shown) similar in internal shape to 34A (or having other shapes) could be designed to replace choke 50 of FIGS. 4, 5 and 7, provided suitable internal threads were provided.

I claim:

1. A choke assembly for installation in the bore of the barrel of a shotgun of predetermined gauge to reduce the gauge of the shotgun bore and to provide a shot pattern of a predetermined characteristic comprising:

a tube having a breech end and a muzzle end, said tube comprising a tube bore having a gauge less than said predetermined gauge, said tube comprising integrally formed axially spaced apart supporting bosses on the exterior thereof of nearly the same diameter as said bore of said shotgun barrel, at least one of said supporting bosses on said tube being located near the muzzle end of said tube, said tube being fabricated of metal selected from a class of metals consisting of aluminum, magnesium and alloys thereof;

a choke having a breech end and a muzzle end, said choke comprising a choke bore, said choke comprising at least two integrally formed axially spaced apart supporting bosses on the exterior thereof of nearly the same diameter as said bore of said shotgun barrel, one of said two supporting bosses being located near said breech end of said choke and the other being located near said muzzle end of said choke, said choke being fabricated of metal selected from a class of metals consisting of steel, stainless steel, titanium and alloys thereof;

and connecting means for connecting said breech end of said choke and said muzzle end of said tube and comprising external threads on said breech end of said choke and internal threads in said muzzle end of said tube which are inter-engaged with each other and solidified adhesive disposed therebetween, said internal threads on said tube being formed within said one supporting boss located at said muzzle end of said tube;

and said external threads on said choke being formed adjacent said one supporting boss located near said breech end of said choke.

2. A choke assembly for installation in the bore of the barrel of a shotgun of predetermined gauge to reduce the gauge of the shotgun bore and to provide a shot pattern of a predetermined characteristic comprising:

a tube having a breech end and a muzzle end, said tube comprising a tube bore having a gauge less than said predetermined gauge, said tube comprising integrally formed axially spaced apart supporting bosses on the exterior thereof of nearly the same diameter as said bore of said shotgun barrel, at least one of said supporting bosses on said tube being located near the muzzle end of said tube, said tube being fabricated of metal selected from a class of metals consisting of aluminum, magnesium and alloys thereof;

a choke having a breech end and a muzzle end, said choke comprising a choke bore, said choke comprising at least two integrally formed axially spaced apart supporting bosses on the exterior thereof of nearly the same diameter as said bore of said shotgun barrel, one of said two supporting bosses being located near said breech end of said choke and the other being located near said muzzle end of said choke, said choke and said adapter member each being fabricated of metal selected from a class of metals consisting of steel, stainless steel, titanium and alloys thereof;

and connecting means for connecting said breech end of said choke and said muzzle end of said tube and comprising internal threads on said choke formed within said one supporting boss located near said breech end of said choke;

internal threads on said tube formed within the supporting boss located near the muzzle end of said tube;

an adapter member comprising an adapter and having a breech end and a muzzle end and having external threads at said breech end and at said muzzle end thereof;

said adapter member comprising an integrally formed supporting boss on the exterior thereof of nearly the same diameter as said bore of said shotgun barrel and disposed between said external threads at said breech end and said muzzle end of said adapter member;

wherein said internal threads on said tube are inter-engaged with said external threads on said breech end of said adapter member;

wherein said internal threads on said choke are inter-engaged with said external threads on said muzzle end of said adapter member;

and solidified adhesive disposed between said inter-engaged threads on said muzzle end of said tube and on said breech end of said adapter member.

* * * * *